US008616527B2

(12) United States Patent
Cho

(10) Patent No.: US 8,616,527 B2
(45) Date of Patent: Dec. 31, 2013

(54) HOIST USING FRICTION WHEEL

(75) Inventor: Duck-Rae Cho, Bucheon-si (KR)

(73) Assignee: KG Inc., Incheon (KR)

( * ) Notice: Subject to any disclaimer, the term of this patent is extended or adjusted under 35 U.S.C. 154(b) by 0 days.

(21) Appl. No.: 13/574,208

(22) PCT Filed: Feb. 23, 2011

(86) PCT No.: PCT/KR2011/001238

§ 371 (c)(1),
(2), (4) Date: Jul. 19, 2012

(87) PCT Pub. No.: WO2011/105790

PCT Pub. Date: Sep. 1, 2011

(65) Prior Publication Data

US 2012/0305869 A1 Dec. 6, 2012

(30) Foreign Application Priority Data

Feb. 26, 2010 (KR) ..... 10-2010-0017716

(51) Int. Cl.
*B66D 1/36* (2006.01)

(52) U.S. Cl.
USPC ..... 254/286; 254/362; 254/278

(58) Field of Classification Search
USPC ..... 254/362, 278, 280, 281, 283, 286, 385
See application file for complete search history.

(56) References Cited

U.S. PATENT DOCUMENTS 5,813,258 A * 9/1998 Cova et al. ..... 70/225
6,983,927 B2 * 1/2006 Pelletier et al. ..... 254/385
2001/0011802 A1 * 8/2001 Meabon ..... 280/47.18
2002/0030182 A1 3/2002 Struck
2008/0191182 A1 8/2008 Arzberger et al.

FOREIGN PATENT DOCUMENTS

JP 06-171893 A 6/1994
JP 2000-219480 A 8/2000
KR 10-0613431 B1 8/2006
KR 10-2010-0031300 A 3/2010
WO 2010/030064 A1 3/2010

OTHER PUBLICATIONS

International Search Report of International Application No. PCT/KR2011/001238, dated Oct. 27, 2011.

* cited by examiner

*Primary Examiner* — Emmanuel M Marcelo
*Assistant Examiner* — Angela Caligiuri
(74) *Attorney, Agent, or Firm* — Kile Park Reed & Houtteman PLLC

(57) ABSTRACT

Disclosed is a hoist using a friction wheel to maximize horizontal movement of a load to be lifted while preventing a wire from deviating from a winding orbit while being wound on a wire drum, the friction wheel having a simplified configuration and being designed to stably support horizontal and vertical movable guide rollers. The hoist includes a single friction wheel on which a wire at a winding side is wound, a wire drum on which the wire at a drawing side is wound, a driven friction wheel through which the wire is guided from the friction wheel to the wire drum, vertical and horizontal stationary guide rollers and vertical and horizontal movable rollers for guidance of the wire, a movable roller mount to horizontally reciprocate the horizontal and vertical movable guide rollers, and upper and lower sheaves to guide the wire to the friction wheel.

5 Claims, 9 Drawing Sheets

HOIST USING FRICTION WHEEL

TECHNICAL FIELD

The present invention relates to a hoist using a friction wheel, and more particularly, to a hoist using a friction wheel, which can maximize a horizontal movement range of a load to be lifted and prevent a wire at a drawing side from deviating from a winding orbit while being wound on a wire drum, the friction wheel used in the hoist having a simplified configuration and being designed to stably support horizontal and vertical movable guide rollers.

BACKGROUND ART

In general, a hoist is used to convey goods in a warehouse and a railroad station and to disassemble and assemble machinery in a plant. The hoist is a kind of machinery, which serves to raise or lower a cargo using a wire and constitutes a group including, e.g., a motor, a reduction gear device and a wire drum, the hoist being provided with a hook at the tip of a wire thereof so as to lift the cargo.

The above described hoist includes a main frame, on which a plurality of parts is installed, the wire drum which is installed on the main frame and is provided at a circumferential surface thereof with a plurality of wire grooves to allow a wire to be wound on the wire drum, a winding sheave and a supporting sheave installed between the wire drum and the hook to guide the wire when the wire is unwound from the wire drum or is wound on the wire drum, a hoisting motor connected to the wire drum to rotate the wire drum, a decelerator installed between the hoisting motor and the wire drum to reduce revolutions per minute of the hoisting motor, a brake connected to the decelerator to control the decelerator, and a traveling unit installed to the main frame to transfer wheels installed to the bottom of the main frame along rails.

In such a conventional hoist, when the wire drum is rotated, the wire is wound on the wire grooves of the wire drum line by line, thereby acting to lift a load block and consequently, causing a load such as a cargo connected to the load block to be pulled up.

Here, since the wire is wound on the wire grooves formed in the surface of the wire drum line by line, the circumferential surface area of the wire drum should be increased in proportion to the rising and falling distance of the load block. Therefore, the longer the rising and falling distance of the load block is, the more increased the length or the diameter of the wire drum is in order to increase the surface area of the wire drum. To this end, a conventionally manufactured hoist requires for a wire drum having a length and a diameter suitable for the rising and falling distance of a load block and thus, there exists a need for the manufacture of various kinds of hoists according to a load lifting height.

Further, if the size of the wire drum is increased based on the increase of the rising and falling distance of the load block, sizes or volumes of related parts are increased that much. That is, the size of the main frame to install the larger wire drum thereon needs to be increased, and the powers of the decelerator and the hoisting motor to drive the larger wire drum need to be increased that much. Therefore, the conventional hoist has problems, such as the increase of the total size of the hoist according to the increase of the rising and falling distance of the load block, and the increase of power consumption.

Moreover, in the above described conventional hoist, the wire is wound on each wire groove of the wire drum line in a single line. Thus, when the wire is wound on or unwound from the wire drum, the wire tends to reciprocate from side to side along the wire groove within the width of the wire drum. As the wire reciprocates from side to side while being wound on or unwound from the wire drum, the wire may be frequently separated from the wire groove.

To solve the above described problem, the applicant of the present invention developed a hoist using friction wheels as disclosed in Korean Patent Application No. 10-2008-0090321.

The aforementioned conventional hoist using friction wheels includes: a pair of friction wheels connected to each other through a pinion, on outer circumferential surfaces of which is closely wound a wire in a single line; a wire drum on which one loose end of the wire at a drawing side is wound when the other end of the wire, connected to a load to be lifted, is pulled up by rotation of the friction wheels; an upper sheave to which the end of the wire at a winding side is secured such that a portion of the wire at the winding side, to which tension is applied by the load, passes through the upper sheave; and a lower sheave located below the upper sheave such that the wire secured to the upper sheave passes through the lower sheave to thereby be wound on the friction wheels, the lower sheave being raised or lowered along with the wire when the wire is wound on or unwound from the friction wheels.

In the above described conventional hoist using friction wheels, the wire at the winding side, to which the weight of the load to be lifted is directly applied, is connected from the lower sheave to the friction wheels through a narrow space between the upper sheave and the friction wheels.

As the wire at the winding side is connected from the lower sheave to the friction wheels through the narrow space, it is impossible to control a position of the lower sheave within a wide range. For example, when the lower sheave is horizontally moved to hang the load to be lifted on the hook, the wire at the winding side may come into contact with the bottom of the friction wheels or the upper sheave, which disadvantageously results in damage to parts in contact with the wire at the winding side to which a great force is applied, or damage to the wire due to unnecessary contact.

In conclusion, positioning the wire at the drawing side, which extends from the lower sheave to the friction wheels, in the narrow space considerably limits a horizontal movement range of the lower sheave and consequently, limits a lifting range of the load, resulting in considerable deterioration in lifting efficiency.

In addition, in the hoist using the conventional friction wheel, the wire at the drawing side may be wound on the wire drum in an unstable state thereof. That is, since the wire at the drawing side is sequentially wound on the circumference of the wire drum while being horizontally reciprocated in a longitudinal direction of the wire drum, the wire may not be stably guided immediately before being wound on the wire drum. This may prevent the wire from being sequentially wound on the circumference of the wire drum starting from one side to the other side of the wire drum and frequently causing the wire to deviate from a winding orbit thereof.

The conventional hoist using friction wheels also suffers from a complicated configuration of the friction wheels. Specifically, the two friction wheels are vertically arranged and the pinion is engaged between the pair of friction wheels to allow the friction wheels to be linked to each other. Thus, the configuration consisting of the two friction wheels and the pinion is somewhat complicated and production costs and assembly difficulty are increased accordingly.

DISCLOSURE OF INVENTION

Technical Problem

Therefore, the present invention has been made in view of the above problems, and it is one object of the present invention to provide a hoist using a friction wheel, which can maximize a horizontal movement range of a load to be lifted.

It is another object of the present invention to provide a hoist using a friction wheel, which can prevent a wire at a drawing side from deviating from a winding orbit thereof while being wound on a wire drum.

It is another object of the present invention to provide a hoist using a friction wheel having a simplified configuration.

It is another object of the present invention to provide a hoist using a friction wheel in which a wire drum can be simply coupled to side plates of a main frame.

It is a further object of the present invention to provide a hoist using a friction wheel, which assures stable support of horizontal and vertical movable guide rollers.

Solution to Problem

The object of the present invention can be achieved by providing a hoist using a friction wheel including a main frame including a pair of side plates and saddles attached to opposite sides of lower ends of the respective side plates such that wheels are mounted to the saddles, a friction wheel installed to the side plates of the main frame and serving to lift a load connected to a wire by frictional interaction between the outer circumference of the friction wheel and the wire wound on an outer circumference of the friction wheel, a friction wheel drive unit installed to the side plates and connected to the friction wheel so as to drive the friction wheel, a wire drum installed to the side plates of the main frame such that a loose portion of the wire at a drawing side is wound on an outer circumference of the wire drum, one end of the wire at the drawing side being wound on the wire drum if the other end of the wire connected to the load is pulled upward by rotation of the friction wheel, a wire drum drive unit installed to the side plates and connected to the wire drum so as to rotate the wire drum, a driven friction wheel installed to the side plates below the friction wheel so as to perform idle rotation and serving to guide the wire at the drawing side having passed through the friction wheel to be wound on the wire drum, a vertical stationary guide roller installed to upper portions of the side plates to have a horizontal rotation center and serving to guide the wire at the drawing side to allow the wire to be drawn from the driven friction wheel to the wire drum, a pair of horizontal stationary guide rollers installed to the top of the side plates near the vertical stationary guide roller to have vertically aligned rotation centers and serving to guide the wire at the drawing side to be drawn from the vertical stationary guide roller to the wire drum, a pair of horizontal movable guide rollers installed to one of the side plates near the horizontal stationary guide roller so as to be horizontally reciprocated in a longitudinal direction of a wire drum drive shaft and serving to guide the wire at the drawing side to allow the wire to be horizontally reciprocated in the longitudinal direction of the wire drum drive shaft, a vertical movable guide roller installed to one of the side plates near the horizontal movable guide rollers so as to be horizontally reciprocated in the longitudinal direction of the wire drum drive shaft and serving to allow the wire at the drawing side to be sequentially wound on an outer circumference of the wire drum, a movable roller mount installed to the side plate so as to be horizontally moved on the wire drum drive shaft and serving to simultaneously horizontally reciprocate the horizontal movable guide rollers and the vertical movable guide roller coupled thereto, a horizontal moving unit including a first sprocket connected to the wire drum drive shaft of the wire drum drive unit, a motor shaft connected to the movable roller mount and provided at both ends thereof with the vertical movable guide rollers, a moving block engaged around the motor shaft and serving to be reciprocated on the motor shaft during rotation of the motor shaft so as to reciprocate the movable roller mount mounted thereon, a second sprocket coupled to the end of the motor shaft to rotate the motor shaft, and a motor chain connected to both the first sprocket and the second sprocket and acting to rotate the second sprocket in linkage with the first sprocket during rotation of the first sprocket, an upper sheave installed to the side plates near the driven friction wheel such that the wire at the winding side, to which tension is applied by the load to be lifted, is wound on the upper sheave, an auxiliary sheave installed at one side of the upper sheave and serving to allow the wire wound on the upper sheave to be guided to the friction wheel by passing through the auxiliary sheave, a lower sheave located below the upper sheave such that the wire is repeatedly wound on the upper sheave and the lower sheave, and a load block installed below the lower sheave and serving to lift the load while being raised and lowered along with the lower sheave.

Each of the side plates may include a wire drum drive shaft recess formed in an upper end close to one lateral edge thereof for installation of the wire drum, a motor shaft hole perforated in an upper position thereof near a wire drum drive shaft for installation of the vertical movable guide roller, a guide shaft hole perforated in an upper position thereof near the motor shaft hole for installation of a guide shaft serving to guide movement of the horizontal movable guide roller, a roller bracket coupled to the upper end thereof near the guide shaft hole and having a coupling hole for installation of the vertical stationary guide roller, a friction wheel coupling hole near the other lateral edge thereof for installation of the friction wheel, a driven friction wheel shaft hole below the friction wheel coupling hole for installation of the driven friction wheel, and at least one position adjustment hole perforated in a lower center portion thereof for installation of the upper sheave.

The wire drum drive shaft recess may be upwardly open such that both the ends of the wire drum drive shaft are seated in the wire drum drive shaft recesses of the two side plates by first positioning both ends of the wire drum drive shaft above the wire drum drive shaft recesses and then lowering them into the wire drum drive shaft recesses. The at least one position adjustment hole may include a plurality of position adjustment holes equidistantly arranged in a horizontal direction of the side plate to enable adjustment of an installation position of the upper sheave.

The wire, one end of which is secured to the upper sheave, may be repeatedly wound in plural lines on the lower sheave and the upper sheave and then be wound on the friction wheel by way of the auxiliary sheave located at one side of the upper sheave, and the wire at the drawing side wound on the friction wheel may be guided to the driven friction wheel so as to be wound on the wire drum by way of the vertical stationary guide roller, the horizontal stationary guide rollers, the horizontal movable guide rollers, and the vertical movable guide roller in sequence.

The movable roller mount may include a pair of stationary brackets, one end of each of which is secured to an upper or lower end of the moving block of the horizontal moving unit, a pair of guide brackets, one end of each of which is secured to the other end of the corresponding stationary bracket, a mounting bracket secured to the top of the other ends of the guide brackets and configured to surround upper and lower sides and front and rear sides of the horizontal movable guide rollers, coupling shafts coupled to the mounting bracket and the horizontal movable guide rollers to allow the pair of horizontal movable guide rollers to be supported by the mounting bracket, and a pair of guide shafts vertically arranged one above another, both ends of each of which are coupled to the side plates to horizontally guide the mounting bracket.

Advantageous Effects of Invention

As is apparent from the above description, in a hoist using a friction wheel according to the present invention, a wire repeatedly wound on upper and lower sheaves is guided to the top of a friction wheel after passing through an auxiliary sheave located at one side of the upper sheave to thereby be wound on the friction wheel. Thus, the wire at a winding side is directly connected from the top of the auxiliary sheave to the top of the friction wheel, rather than passing through a narrow vertical space between the friction wheel and the upper sheave, which prevents the wire at the winding side extending from the upper sheave to the friction wheel from coming into contact with other parts even in the event of horizontal movement of the upper or lower sheave and in turn, prevents damage to the parts or the wire. Further, considerably expanding a horizontal movement range of the upper or lower sheave can result in an expanded lifting range of a load with considerably enhanced lifting efficiency.

According to the present invention, a vertical movable guide roller is installed to a side plate near a horizontal movable guide roller so as to be horizontally reciprocated on a wire drum drive shaft to allow the wire at a drawing side to be gradually wound on the outer circumference of a wire drum. As the wire at the drawing side wound on the wire drum is gradually wound on the circumference of the wire drum by being moved from one side to the other side of the wire drum under the guidance of the vertical movable guide roller, the wire is stably wound on the wire drum without deviating from a winding orbit thereof.

According to the present invention, a single friction wheel is mounted on the friction wheel drive shaft, which results in a more simplified configuration than the previously described conventional hoist using a pair of friction wheels and a pinion and in turn, reduced product costs and more simplified assembly operation.

According to the present invention, a driven friction wheel is installed below the friction wheel so as to perform idle rotation. The driven friction wheel serves only to guide the wire and thus, is rotated at the same revolutions per minute as the friction wheel, which can prevent slippage between the friction wheel, the driven friction wheel and the wire.

According to the present invention, a wire drum drive shaft recess formed in the side plate is upwardly open such that both the ends of the wire drum drive shaft can be simply seated in the wire drum drive shaft recesses of the two side plates by first positioning both ends of the wire drum drive shaft above the wire drum drive shaft recesses and then lowering them into the wire drum drive shaft recesses. Thus, the wire drum can be assembled to or disassembled from the side plates of a main frame in a very simple manner, which results in a considerable reduction in the assembly and service times.

According to the present invention, the horizontal movable guide rollers are stably installed to a mounting bracket surrounding upper and lower sides and front and rear sides of the horizontal movable guide rollers, and to coupling shafts coupled to the mounting bracket and the horizontal movable guide rollers to allow the horizontal movable guide rollers to be supported by the mounting bracket. In addition, the horizontal and vertical movable guide rollers are installed to the movable roller mount, which is installed to the side plate so as to come into contact at three points with a single motor shaft and two guide shafts. Thus, as the movable roller mount is stably reciprocated on the guide shafts while being supported at the aforementioned three points, the horizontal and vertical movable guide rollers installed to the movable roller mount are movable while being kept in a stably supported state, which assures that the wire at the drawing side be stably wound on the wire drum without deviating from a winding orbit thereof.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to characteristics and advantages of embodiments of the present invention, examples of which are illustrated in the accompanying drawings.

Figure 1:
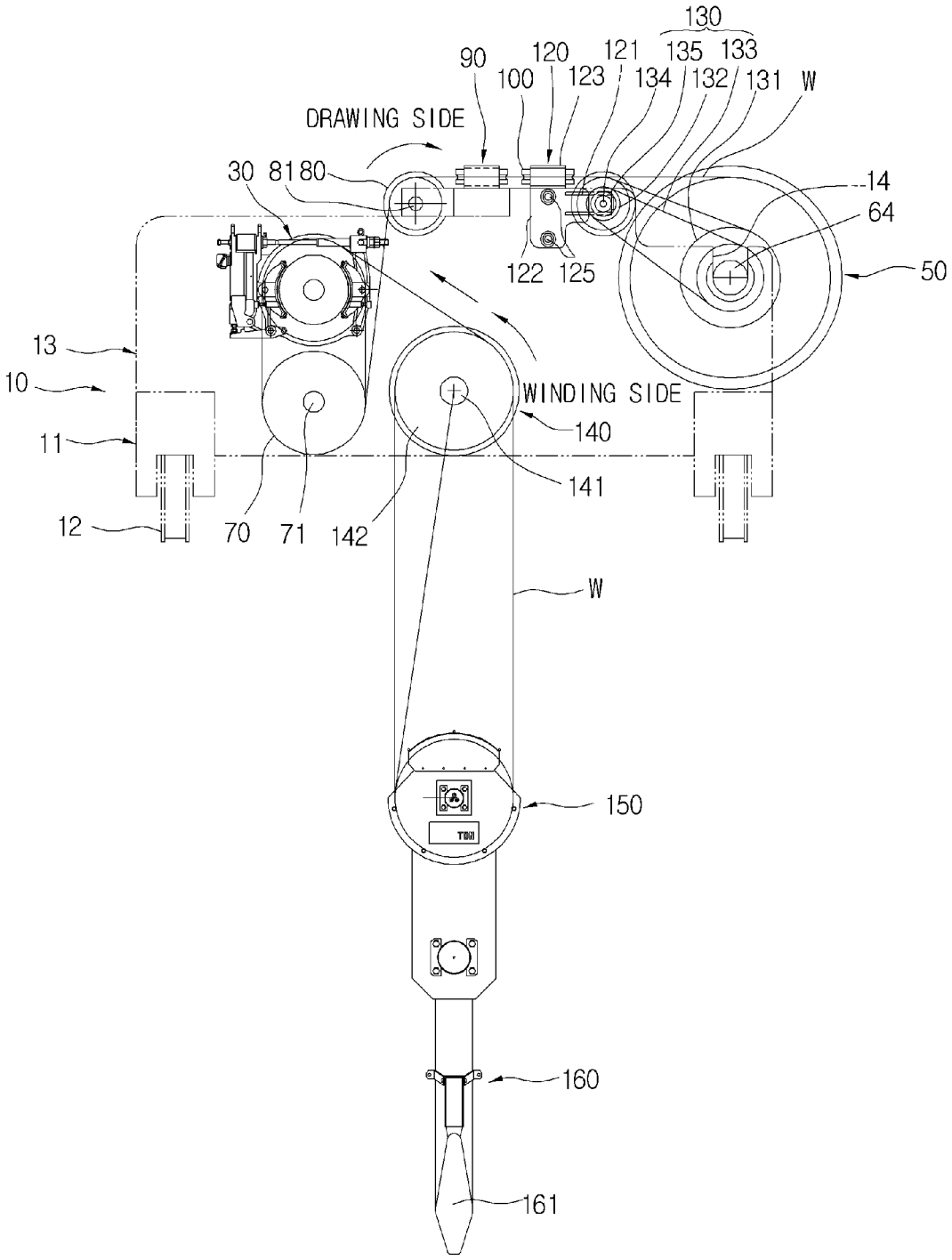
FIG. 1 is a schematic front view illustrating a hoist using a friction wheel in accordance with the present invention.
Figure 2:
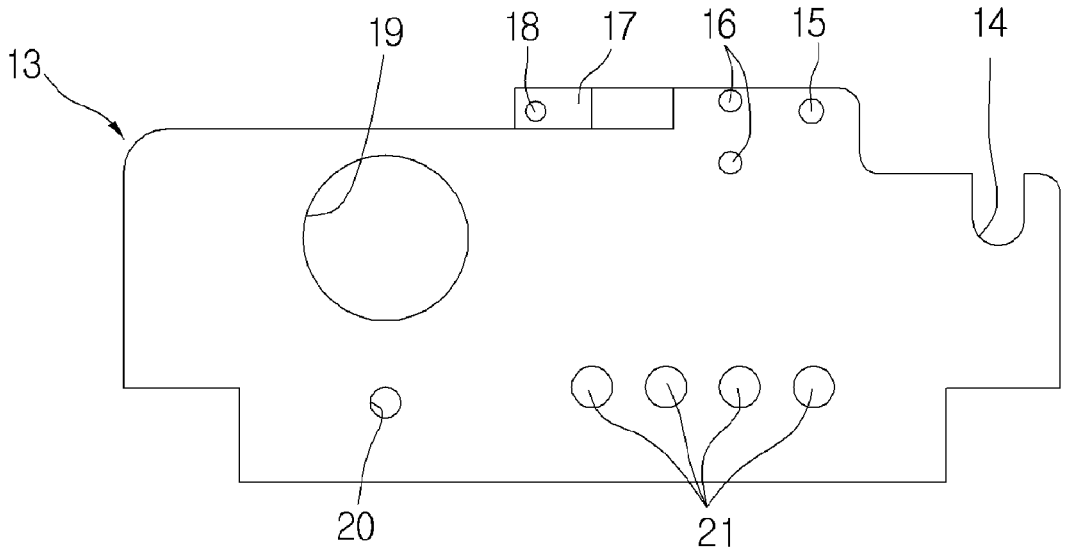
FIG. 2 is a front view of a side plate included in the hoist.
Figure 3:
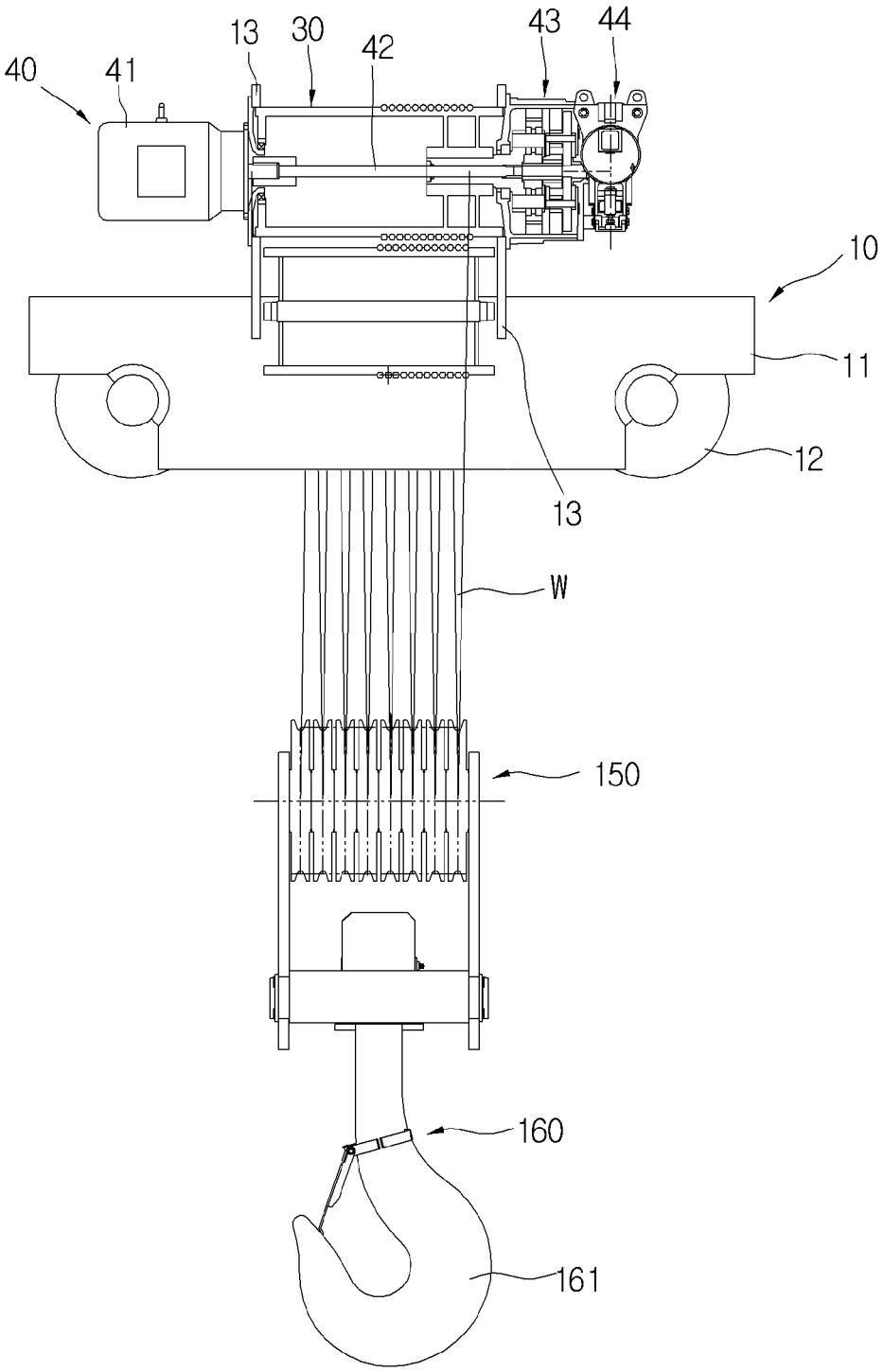
FIG. 3 is a schematic side view of FIG. 1.
Figure 4:
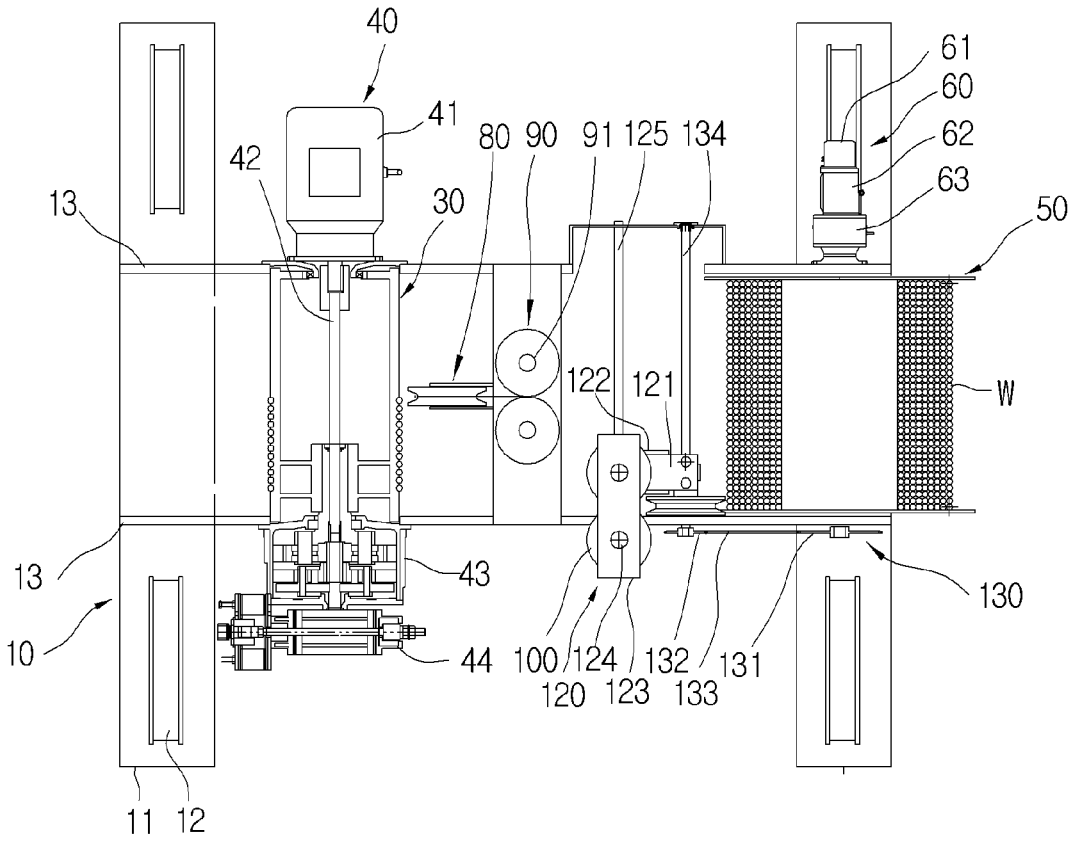
FIG. 4 is a schematic plan view of FIG. 1.
Figure 5:
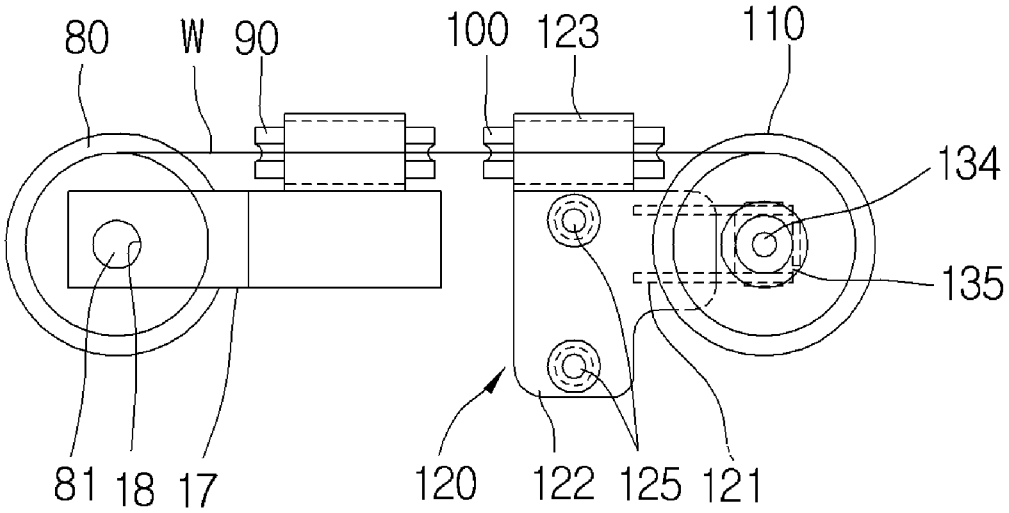
FIG. 5 is a partial front view illustrating important parts of the present invention.
Figure 6:
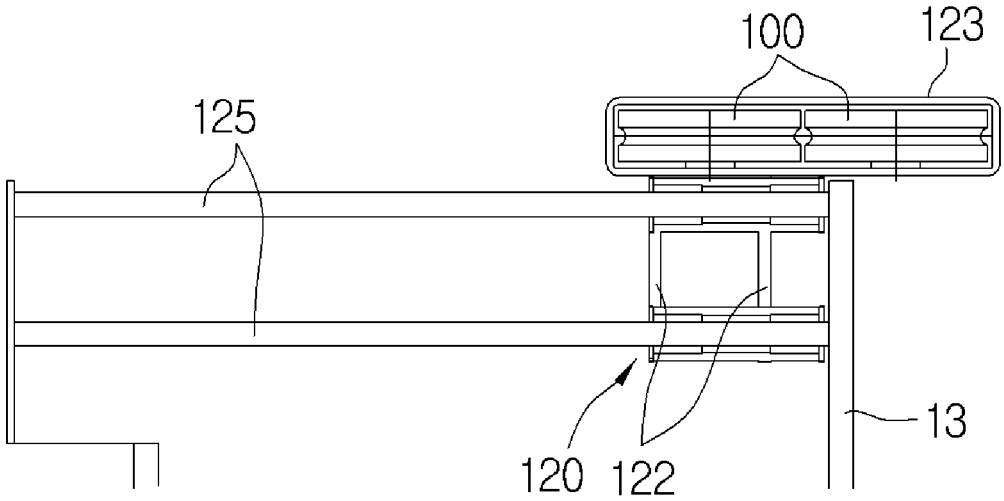
FIG. 6 is a partial side view illustrating a coupling configuration of a horizontal movable guide roller.
Figure 7:
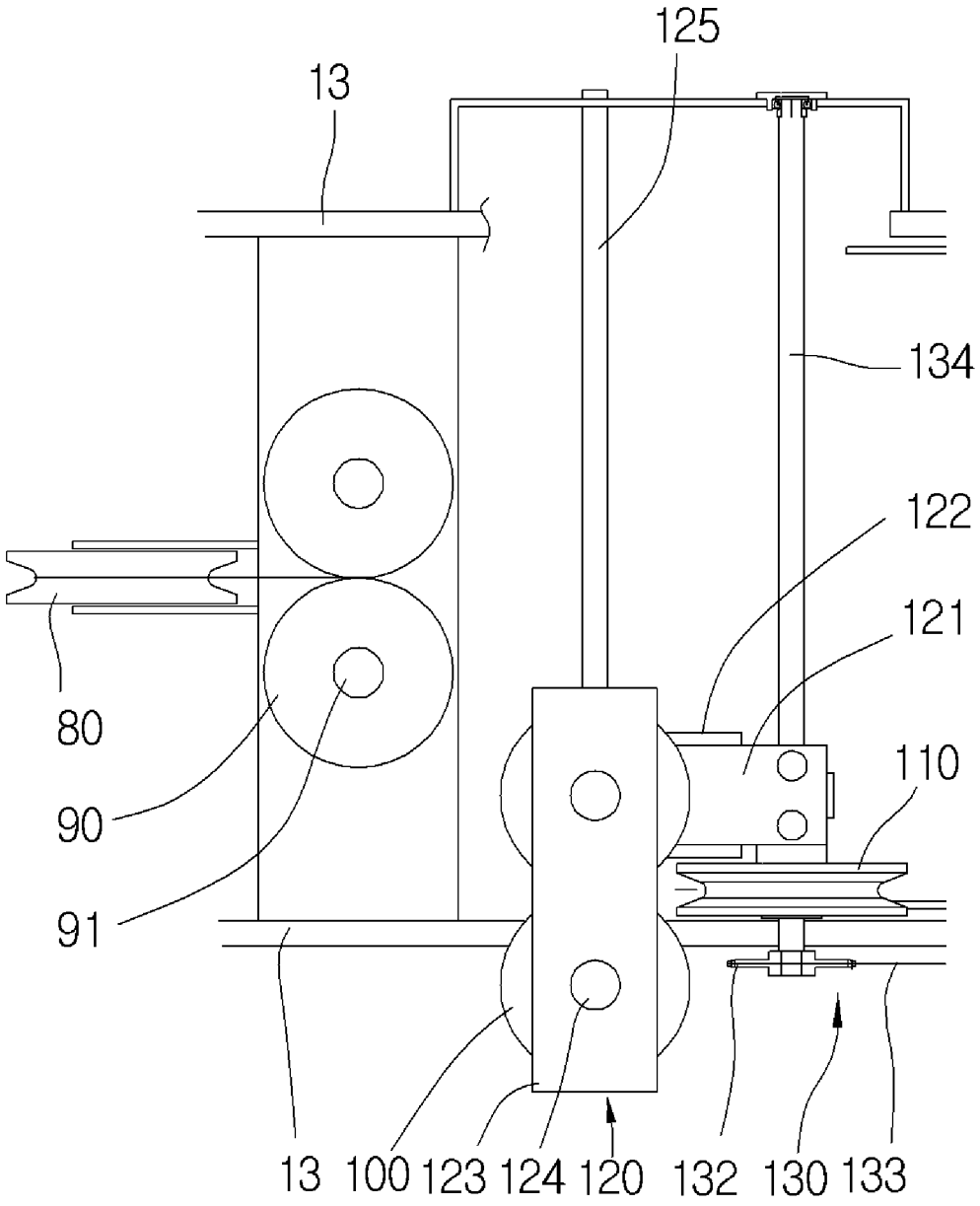
FIG. 7 is a partial plan view of FIG. 4.
Figure 8:
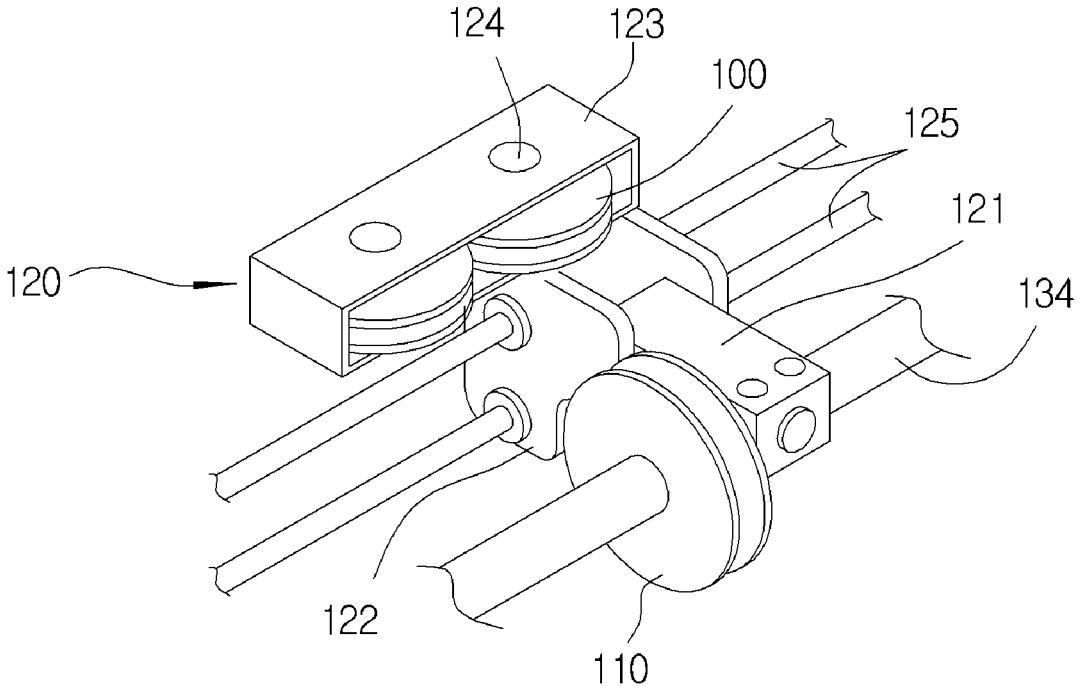
FIG. 8 is a schematic partial perspective view illustrating an installation configuration of a horizontal movable guide roller and a vertical movable guide roller.
Figure 9:
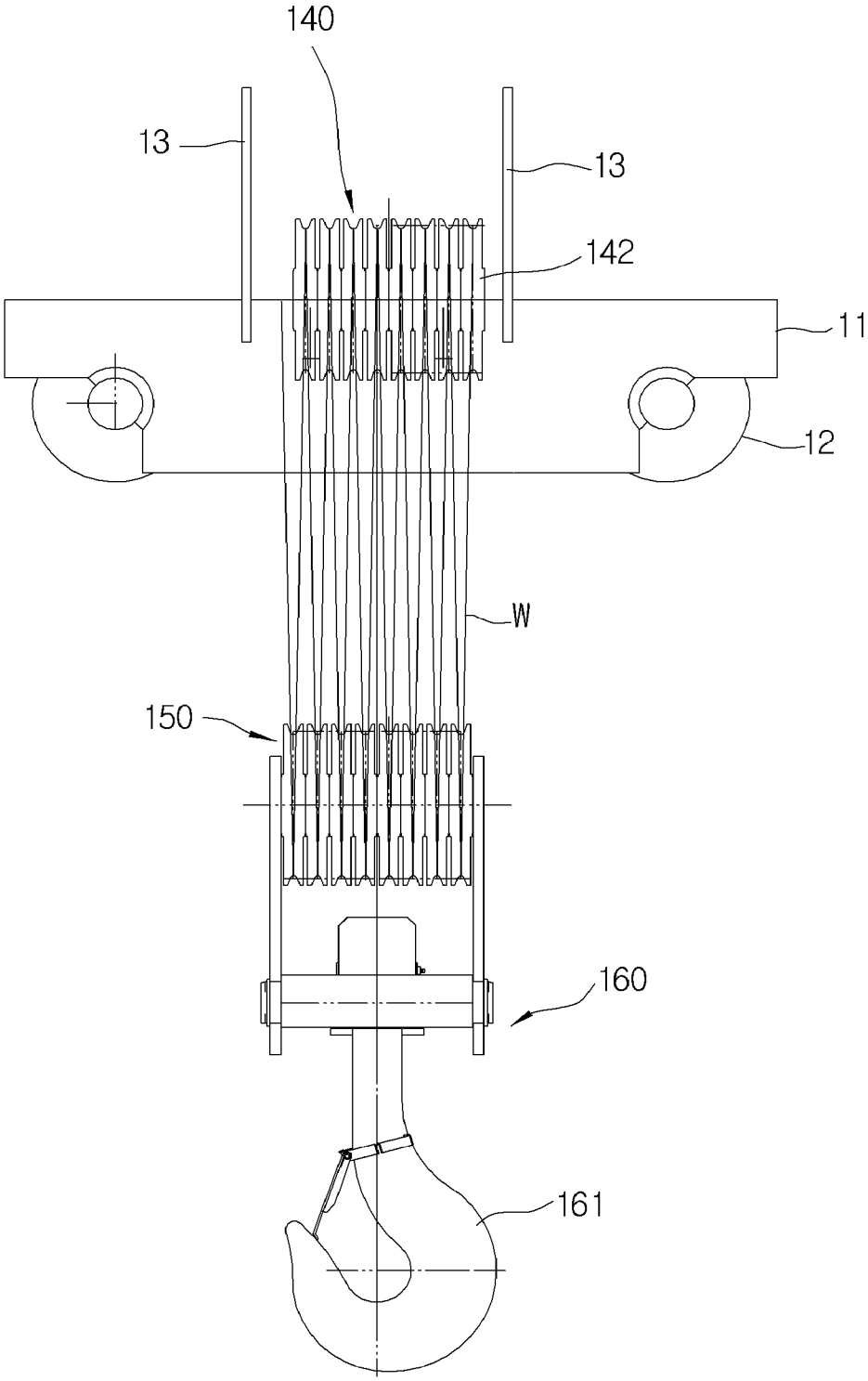
FIG. 9 is a partial front view illustrating an auxiliary sheave.

FIG. 1 is a schematic front view illustrating a hoist using a friction wheel in accordance with the present invention, FIG. 2 is a front view of a side plate included in the hoist, FIG. 3 is a schematic side view of FIG. 1, FIG. 4 is a schematic plan view of FIG. 1, FIG. 5 is a partial front view illustrating important parts of the present invention, FIG. 6 is a partial side view illustrating a coupling configuration of a horizontal movable guide roller, FIG. 7 is a partial plan view of FIG. 4, FIG. 8 is a schematic partial perspective view illustrating an installation configuration of a horizontal movable guide roller and a vertical movable guide roller, and FIG. 9 is a partial front view illustrating an auxiliary sheave.

The hoist using a friction wheel in accordance with the present invention includes a main frame 10, a friction wheel 30, a friction wheel drive unit 40, a wire drum 50, a wire drum drive unit 60, a driven friction wheel 70, a vertical stationary guide roller 80, horizontal stationary guide rollers 90, horizontal movable guide rollers 100, a vertical movable guide roller 110, a movable roller mount 120, a horizontal moving unit 130, an upper sheave 140, a lower sheave 150, and a load block 160.

The main frame 10 includes a pair of side plates 13 and saddles 11 attached to opposite sides of lower ends of the respective side plates 13 such that wheels 12 are mounted to the saddles 11.

Each of the side plates 13 has a wire drum drive shaft recess 14 formed in an upper end close to one lateral edge thereof such that the wire drum 50 is installed therein, a motor shaft hole 15 perforated in an upper position thereof near a wire drum drive shaft 64 such that the vertical movable guide roller 110 is installed therein, and guide shaft holes 16 perforated in an upper positions thereof near the motor shaft hole 15 such that guide shafts 125 serving to guide movement of the horizontal movable guide roller 100 are installed therein.

Here, both ends of the wire drum drive shaft 64 are inserted into the wire drum drive shaft recesses 14 of the pair of side plates 13 from the upper side thereof. To this end, the wire drum drive shaft recesses 14 are upwardly open such that both ends of the wire drum drive shaft 64 are seated in the wire drum drive shaft recesses 14.

A roller bracket 17 is coupled to the upper end of each side plate 13 near the guide shaft holes 16. The roller bracket 17 has a coupling hole 18 for installation of the vertical stationary guide roller 80. The side plate 13 further has a friction wheel coupling hole 19 near the other lateral edge thereof for installation of the friction wheel 30, a driven friction wheel shaft hole 20 below the friction wheel coupling hole 19 for installation of the driven friction wheel 70, and position adjustment holes 21 perforated in a lower center portion of the side plate 13 for installation of the upper sheave 140.

An upper sheave shaft 141 is fitted through one of the position adjustment holes 21 for installation of the upper sheave 140. To adjust an installation position of the upper sheave 140 as occasion demands, a plurality of position adjustment holes 21 is equidistantly arranged in a horizontal direction of the side plate 13.

With the above described configuration, as the upper sheave shaft 141 is fitted into any one of the plurality of position adjustment holes 21, the installation position of the upper sheave 140 can be adjusted.

Both ends of the friction wheel 30 are fitted into the friction wheel coupling holes 19 perforated respectively in the pair of side plates 13 of the main frame 10. A wire W is wound on an outer circumference of the friction wheel 30. The friction wheel 30 serves to lift a load connected to the wire W by frictional interaction between the wire W and the outer circumference of the friction wheel 30.

The friction wheel drive unit 40 is installed to the side plates 13 and is connected to the friction wheel 30 so as to drive the friction wheel 30.

The friction wheel drive unit 40 includes a friction wheel drive motor 41, a friction wheel drive shaft 42, a friction wheel decelerator 43, and a friction wheel brake 44. The friction wheel drive motor 41 is installed to one of the side plates 13 and is connected to the friction wheel 30 to apply rotational force to the friction wheel 30. The friction wheel drive shaft 42 is coupled to the friction wheel drive motor 41 and is located in the center of the friction wheel 30 to transmit the rotational force of the friction wheel drive motor 41 to the friction wheel 30. The friction wheel decelerator 43 is installed to the other side plate 13 and is connected to the friction wheel drive shaft 42 and the friction wheel 30 to transmit the rotational force from the friction wheel drive shaft 42 to the friction wheel 30 after reducing the rotational force. The friction wheel brake 44 is installed to the friction wheel decelerator 43 and is connected to the friction wheel drive shaft 42 to control rotation of the friction wheel drive shaft 42.

The wire drum 50 is installed to the side plates 13 of the main frame 10 such that a loose portion of the wire W at a drawing side is wound on the wire drum 50. If the friction wheel 30 is rotated to upwardly pull one end of the wire W connected to a load to be lifted, the other end of the wire W at the drawing side is wound on the wire drum 50.

The wire drum drive unit 60 is installed to the side plates 13 and is connected to the wire drum 50 so as to rotate the wire drum 50.

The wire drum drive unit 60 includes a wire drum drive motor 61, a wire drum drive shaft 64, a wire drum brake 62, and a wire drum decelerator 63. The wire drum drive motor 61 is installed to one of the side plates 13 and is connected to the wire drum 50 to apply rotational force to the wire drum drive motor 61. The wire drum drive shaft 64 is coupled to the wire drum drive motor 61 and is located in the center of the wire drum 50 to transmit the rotational force of the wire drum drive motor 61 to the wire drum 50. The wire drum brake 62 is coupled to one side of the wire drum drive motor 61 and is connected to the wire drum drive shaft 64 to control rotation of the wire drum drive shaft 64. The wire drum decelerator 63 is coupled to one side of the wire drum brake 62 and is connected to both the wire drum drive shaft 64 and the wire drum 50 to transmit the rotational force from the wire drum drive shaft 64 to the wire drum 50 after reducing the rotational force.

The driven friction wheel 70 is installed to the side plates 13 below the friction wheel 30 and serves to guide the wire W at the drawing side having passed through the friction wheel 30 to allow the wire W to be wound on the wire drum 50.

The driven friction wheel 70 is installed on a driven friction wheel shaft 71 fitted into the driven friction wheel shaft holes 20 of the side plates 13. The wire W at the drawing side having passed through the friction wheel 30 passes through the driven friction wheel 70 and subsequently, passes through the vertical stationary guide roller 80.

In the previously described conventional hoist using friction wheels in which two friction wheels are connected to each other with a pinion engaged therebetween so as to be rotated in linkage with each other, the two friction wheels may differ in terms of revolutions per minute due to mechanical tolerance with the engaged pinion. This may cause slippage between the two friction wheels and a wire wound thereon, resulting in damage to the wire.

On the other hand, in the present invention, the driven friction wheel 70 is installed below the friction wheel 30 to perform idle rotation and serves only to guide the wire W. Thus, the driven friction wheel 70 is rotated according to the revolutions per minute of the friction wheel 30, causing no slippage between the friction wheel 30, the driven friction wheel 70 and the wire W.

The vertical stationary guide roller 80 serves to guide the wire W at the drawing side to be drawn from the driven friction wheel 70 to the wire drum 50 and is installed to the upper portions of the side plates 13 such that a rotation center thereof is horizontally set. Specifically, the vertical stationary guide roller 80 is installed on a horizontal shaft 81 fitted into the coupling holes 18 of the roller brackets 17 such that the vertical stationary guide roller 80 guides the wire W at the drawing side having passed through the driven friction wheel 70.

The horizontal stationary guide rollers 90 are installed to the top of the side plates 13 near the vertical stationary guide roller 80 and serve to guide the wire W at the drawing side to be drawn from the vertical stationary guide roller 80 to the wire drum 50. The horizontal stationary guide rollers 90 are coupled respectively to a pair of vertical shafts 91 to guide the wire W at the drawing side having passed through the vertical stationary guide roller 80.

The horizontal movable guide rollers 100 are installed to one of the side plates 13 near the horizontal stationary guide roller 90. The horizontal movable guide rollers 100 are installed to be horizontally reciprocated in a longitudinal direction of the wire drum drive shaft 64 and serve to guide the wire W at the drawing side to allow the wire W to be horizontally reciprocated in the longitudinal direction of the wire drum drive shaft 64. The horizontal movable guide rollers 100 are coupled respectively to coupling shafts 124 of the movable roller mount 120 which will be described hereinafter.

The vertical movable guide roller 110 is installed to the side plate 13 near the horizontal movable guide rollers 100. The vertical movable guide roller 110 is installed to horizontally reciprocate in the longitudinal direction of the wire drum drive shaft 64 and serves to allow the wire W at the drawing side to be sequentially wound on an outer circumference of the wire drum 50. The vertical movable guide roller 110 is coupled to an end of a motor shaft 134 of the horizontal moving unit 130 which will be described hereinafter.

The movable roller mount 120 is installed to the side plate 13 so as to be horizontally moved on the wire drum drive shaft 64. The horizontal movable guide rollers 100 and the vertical movable guide roller 110 are coupled to the movable roller mount 120 and are simultaneously horizontally reciprocated by the movable roller mount 120.

The movable roller mount 120 includes a pair of stationary brackets 121, a pair of guide brackets 122, a mounting bracket 123, the coupling shafts 124, and a pair of guide shafts 125.

One end of each of the pair of stationary brackets 121 is secured to an upper or lower end of a moving block 135 of the horizontal moving unit 130 which will be described hereinafter.

One end of each of the pair of guide brackets 122 is secured to the other end of the corresponding stationary bracket 121.

The mounting bracket 123 is secured to the top of the other ends of the guide brackets 122 and is configured to surround upper and lower sides and front and rear sides of the horizontal movable guide rollers 100.

The coupling shafts 124 are coupled to the mounting bracket 123 and the horizontal movable guide rollers 100 to allow the pair of horizontal movable guide rollers 100 to be supported by the mounting bracket 123.

The pair of guide shafts 125 is vertically arranged one above another and both ends of the respective guide shafts 125 are coupled to the side plates 13 to horizontally guide the mounting bracket 123.

The horizontal moving unit 130 includes a first sprocket 131, the motor shaft 134, the moving block 135, a second sprocket 132, and a motor chain 133.

The first sprocket 131 is connected to the wire drum drive shaft 64 of the wire drum drive unit 60 to receive rotational force of the wire drum drive shaft 64. The motor shaft 134 takes the form of a screw shaft and is connected to the movable roller mount 120. The vertical movable guide roller 110 is installed to the end of the motor shaft 134.

The moving block 135 is engaged around the motor shaft 134 and the movable roller mount 120 is mounted on the moving block 135. The moving block 135 is reciprocated in the longitudinal direction of the motor shaft 134 during rotation of the motor shaft 134, thereby reciprocating the movable roller mount 120. The second sprocket 132 is coupled to the end of the motor shaft 134 to transmit rotational force from the first sprocket 131 to the motor shaft 134. The motor chain 133 is connected to both the first sprocket 131 and the second sprocket 132 and acts to rotate the second sprocket 132 in linkage with the first sprocket 131 during rotation of the first sprocket 131.

The upper sheave shaft 141 of the upper sheave 140 is installed to the side plates 13 such that the upper sheave 140 is located near the driven friction wheel 70. The wire W at a winding side, to which tension is applied by the load to be lifted, is fixedly wound on the upper sheave 140. The wire W is then wound on an auxiliary sheave 142 prior to being wound on the friction wheel 30.

The auxiliary sheave 142 is fitted on the upper sheave shaft 141 at one side of the upper sheave 140 such that the wire W wound on the upper sheave 140 passes through the auxiliary sheave 142, thereby being guided to the friction wheel 30 by the auxiliary sheave 142.

The lower sheave 150 is located below the upper sheave 140 such that the wire W is wound on the lower sheave 150. Specifically, the wire W, one end of which is secured to the upper sheave 140, is wound on the lower sheave 150 and is again guided to the upper sheave 140 so as to be repeatedly wound on the upper sheave 140 and the lower sheave 150.

After being repeatedly wound on the lower sheave 150 and the upper sheave 140, the wire W passes through the auxiliary sheave 142 located at one side of the upper sheave 140 so as to be guided from the top of the auxiliary sheave 142 to the top of the friction wheel 30, thereby being wound on the friction wheel 30.

The load block 160 is installed below the lower sheave 150 and includes a hook 161 by which the load to be lifted is caught.

In the hoist using a friction wheel having the above described configuration, the wire W is wound along the following path.

Specifically, after one end of the wire W is secured to the upper sheave 140, the wire W is repeatedly wound on the lower sheave 150 and the upper sheave 140 in sequence.

The wire W at the drawing side, which has been wound on the upper sheave 140 to receive the weight of a load to be lifted, is guided to the friction wheel 30 after passing through the auxiliary sheave 142. After being wound on the friction wheel 30, the wire W is guided to the driven friction wheel 70 below the friction wheel 30 so as to be wound on the wire drum 50. To this end, the wire W at the drawing side having passed through the driven friction wheel 70 is guided to the vertical stationary guide roller 80.

The wire W at the drawing side guided to the vertical stationary guide roller 80 passes through the pair of horizontal stationary guide rollers 90 and the pair of horizontal movable guide rollers 100 in sequence. The wire W at the drawing side guided to the horizontal movable guide rollers 100 is finally guided to the wire drum 50 after passing through the vertical movable guide roller 110.

Hereinafter, operation of the hoist using a friction wheel as described above will be described.

If the friction wheel drive motor 41 is driven, the friction wheel decelerator 43 linked to the friction wheel drive shaft 42 rotates the friction wheel 30. If the friction wheel 30 is rotated, the wire W at the winding side wound on the upper sheave 140 and the lower sheave 150 is pulled up so as to be wound on the friction wheel 30. Thereby, the wire W acts to pull the lower sheave 150 upward, causing the hook 161 and a load connected to the wire W to be lifted.

In the meantime, the wire drum drive motor 61 is driven simultaneously with operation of the friction wheel drive motor 41.

If the wire drum drive motor 61 is rotated, the wire drum decelerator 63 liked to the wire drum drive shaft 64 rotates the wire drum 50. As the wire drum 50 is rotated simultaneously with rotation of the friction wheel 30, the wire W at the drawing side having passed through the driven friction wheel 70 is wound on the wire drum 50.

The horizontal moving unit 130 is connected to the wire drum drive shaft 64 and in turn, the movable roller mount 120 is installed to the horizontal moving unit 130. The movable roller mount 120 is provided with the horizontal movable guide rollers 100 and the vertical movable guide roller 110.

With the above described configuration, if the wire drum drive shaft 64 is rotated, the first sprocket 131 of the horizontal moving unit 130 connected to the wire drum drive shaft 64 is rotated, causing the motor chain 133 and the second sprocket 132 to be rotated, in turn causing the motor shaft 134 connected to the second sprocket 132 to be rotated.

The moving block 135 engaged with the motor shaft 134 is horizontally reciprocated about the motor shaft 134 during rotation of the motor shaft 134, thereby acting to horizontally reciprocate the movable roller mount 120 installed to the moving block 135. Accordingly, if the wire drum 50 is rotated, the horizontal movable guide rollers 100 and the vertical movable guide roller 110 are moved in the longitudinal direction of the wire drum drive shaft 64 of the wire drum 50, thereby allowing the wire W at the drawing side to be sequentially wound on the wire drum 50.

MODE FOR THE INVENTION

Various embodiments have been described in the best mode for carrying out the invention.

INDUSTRIAL APPLICABILITY

The hoist using a friction wheel according to the present invention has the following advantages.

Firstly, the wire W at the winding side, wound on the upper sheave 140 and the lower sheave 150, is guided to the top of the friction wheel 30 after passing through the auxiliary sheave 142 located at one side of the upper sheave 140 so as to be wound on the friction wheel 30.

According to the present invention, the wire W at the winding side is directly connected from the top of the auxiliary sheave 142 to the top of the friction wheel 30, rather than passing through a narrow vertical space between the friction wheel 30 and the upper sheave 140. This has the effect of preventing the wire W at the winding side extending from the auxiliary sheave 142 to the friction wheel 30 from coming into contact with other parts even in the event of horizontal movement of the upper sheave 140 or the lower sheave 150.

Preventing the wire W at the winding side from coming into contact with other parts even in the event of horizontal movement of the upper sheave 140 or the lower sheave 150 can prevent damage to the parts or the wire W. Further, considerably expanding a horizontal movement range of the upper sheave 140 or the lower sheave 150 is possible, which results in a lifting range of a load with considerably enhanced lifting efficiency.

Secondly, the vertical movable guide roller 110 is installed to the side plate 13 near the horizontal movable guide roller 100. The vertical movable guide roller 110 is horizontally reciprocated on the wire drum drive shaft 64 to allow the wire W at the drawing side to be gradually wound on the outer circumference of the wire drum 50.

As the wire W at the drawing side wound on the wire drum 50 is gradually wound on the circumference of the wire drum 50 by being moved from one side to the other side of the wire drum 50 under the guidance of the vertical movable guide roller 110, it is possible to assure that the wire W be stably wound on the wire drum 50 without deviating from a winding orbit thereof.

Thirdly, according to the present invention, the single friction wheel 30 is mounted on the friction wheel drive shaft 42, which results in a more simplified configuration than the previously described conventional hoist using a pair of friction wheels and a pinion. Thus, the hoist of the present invention can achieve reduced product costs and more simplified assembly operation.

Fourthly, in the case of the conventional hoist in which the two friction wheels are rotatably engaged with each other with the pinion interposed therebetween, the two friction wheels have different revolutions per minute due to mechanical tolerance with the engaged pinion, which results in slippage between a wire and the two friction wheels and consequently, damage to the wire.

However, differently from the conventional hoist, the hoist of the present invention is configured such that the driven friction wheel 70 is installed below the friction wheel 30 so as to perform idle rotation. The driven friction wheel 70 serves only to guide the wire W and thus, is rotated at the same revolutions per minute as the friction wheel 30, which can prevent slippage between the friction wheel 30, the driven friction wheel 70 and the wire W.

Fifthly, according to the present invention, the wire drum drive shaft recess 14 formed in the side plate 13 is upwardly open.

Both the ends of the wire drum drive shaft 64 can be simply seated in the wire drum drive shaft recesses 14 of the two side plates 13 by first positioning both ends of the wire drum drive shaft 64 above the wire drum drive shaft recesses 14 and then lowering them into the wire drum drive shaft recesses 14. Thus, the wire drum 50 can be assembled to or disassembled from the side plates 13 of the main frame 10 in a very simple manner, which results in a considerable reduction in the assembly and service times of the hoist according to the present invention.

Sixthly, according to the present invention, the horizontal movable guide rollers 100 are stably installed to the mounting bracket 123, which surrounds upper and lower sides and front and rear sides of the horizontal movable guide rollers 100, and the coupling shafts 124 coupled to the mounting bracket 123 and the horizontal movable guide rollers 100 to allow the pair of horizontal movable guide rollers 100 to be supported by the mounting bracket 123.

In addition, the horizontal movable guide rollers 100 and the vertical movable guide roller 110 are installed to the movable roller mount 120. The movable roller mount 120 is installed to the side plate 13 so as to come into contact at three points with the single motor shaft 134 and the two guide shafts 125.

As the movable roller mount 120 is stably reciprocated on the guide shafts 125 while being supported at the aforementioned three points, the horizontal movable guide rollers 100 and the vertical movable guide roller 110 installed to the movable roller mount 120 are movable while being kept in a stably supported state, which assures that the wire W at the drawing side be stably wound on the wire drum 50 without deviating from a winding orbit thereof.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A hoist using a friction wheel comprising:

a main frame including a pair of side plates and saddles attached to opposite sides of lower ends of the respective side plates such that wheels are mounted to the saddles;

a friction wheel installed to the side plates of the main frame and serving to lift a load connected to a wire by frictional interaction between an outer circumference of the friction wheel and the wire wound on the outer circumference of the friction wheel;

a friction wheel drive unit installed to the side plates and connected to the friction wheel so as to drive the friction wheel;

a wire drum installed to the side plates of the main frame such that a loose portion of the wire at a drawing side is wound on an outer circumference of the wire drum, one end of the wire at the drawing side being wound on the wire drum if the other end of the wire connected to the load is pulled upward by rotation of the friction wheel;

a wire drum drive unit installed to the side plates and connected to the wire drum so as to rotate the wire drum;

a driven friction wheel installed to the side plates below the friction wheel so as to perform idle rotation and serving to guide the wire at the drawing side having passed through the friction wheel to be wound on the wire drum;

a vertical stationary guide roller installed to upper portions of the side plates to have a horizontal rotation center and serving to guide the wire at the drawing side to allow the wire to be drawn from the driven friction wheel to the wire drum;

a pair of horizontal stationary guide rollers installed to the top of the side plates near the vertical stationary guide roller to have vertically aligned rotation centers and serving to guide the wire at the drawing side to be drawn from the vertical stationary guide roller to the wire drum;

a pair of horizontal movable guide rollers installed to one of the side plates near the horizontal stationary guide rollers so as to be horizontally reciprocated in a longitudinal direction of a wire drum drive shaft and serving to guide the wire at the drawing side to allow the wire to be horizontally reciprocated in the longitudinal direction of the wire drum drive shaft;

a vertical movable guide roller installed to one of the side plates near the horizontal movable guide rollers so as to be horizontally reciprocated in the longitudinal direction of the wire drum drive shaft and serving to allow the wire at the drawing side to be sequentially wound on the outer circumference of the wire drum;

a movable roller mount installed to the side plate so as to be horizontally moved on the wire drum drive shaft and serving to simultaneously horizontally reciprocate the horizontal movable guide rollers and the vertical movable guide roller coupled thereto;

a horizontal moving unit including a first sprocket connected to the wire drum drive shaft of the wire drum drive unit, a motor shaft connected to the movable roller mount and provided at both ends thereof with the vertical movable guide rollers, a moving block engaged around the motor shaft and serving to be reciprocated on the motor shaft during rotation of the motor shaft so as to reciprocate the movable roller mount mounted thereon, a second sprocket coupled to the end of the motor shaft to rotate the motor shaft, and a motor chain connected to both the first sprocket and the second sprocket and acting to rotate the second sprocket in linkage with the first sprocket during rotation of the first sprocket;

an upper sheave installed to the side plates near the driven friction wheel such that the wire at the winding side, to which tension is applied by the load to be lifted, is wound on the upper sheave;

an auxiliary sheave installed at one side of the upper sheave and serving to allow the wire wound on the upper sheave to be guided to the friction wheel by passing through the auxiliary sheave;

a lower sheave located below the upper sheave such that the wire is repeatedly wound on the upper sheave and the lower sheave; and a load block installed below the lower sheave and serving to lift the load while being raised and lowered along with the lower sheave, wherein the movable roller mount includes:

a pair of stationary brackets, one end of each of which is secured to an upper or lower end of the moving block of the horizontal moving unit;

a pair of guide brackets, one end of each of which is secured to the other end of the corresponding stationary bracket;

a mounting bracket secured to the top of the other ends of the guide brackets and configured to surround upper and lower sides and front and rear sides of the horizontal movable guide rollers;

coupling shafts coupled to the mounting bracket and the horizontal movable guide rollers to allow the pair of horizontal movable guide rollers to be supported by the mounting bracket; and a pair of guide shafts vertically arranged one above another, both ends of each of which are coupled to the side plates to horizontally guide the mounting bracket.

2. The hoist according to claim 1, wherein each of the side plates includes:

a wire drum drive shaft recess formed in an upper end close to one lateral edge thereof for installation of the wire drum;

a motor shaft hole perforated in an upper position thereof near the wire drum drive shaft for installation of the vertical movable guide roller;

a guide shaft hole perforated in an upper position thereof near the motor shaft hole for installation of a guide shaft serving to guide movement of the horizontal movable guide roller;

a roller bracket coupled to the upper end thereof near the guide shaft hole and having a coupling hole for installation of the vertical stationary guide roller;

a friction wheel coupling hole near an other lateral edge thereof for installation of the friction wheel;

a driven friction wheel shaft hole below the friction wheel coupling hole for installation of the driven friction wheel; and at least one position adjustment hole perforated in a lower center portion thereof for installation of the upper sheave.

3. The hoist according to claim 2, wherein the wire drum drive shaft recess is upwardly open such that both the ends of the wire drum drive shaft are seated in the wire drum drive shaft recesses of the two side plates by first positioning both ends of the wire drum drive shaft above the wire drum drive shaft recesses and then lowering them into the wire drum drive shaft recesses.

4. The hoist according to claim 2, wherein the at least one position adjustment hole includes a plurality of position adjustment holes equidistantly arranged in a horizontal direction of the side plate to enable adjustment of an installation position of the upper sheave.

5. The hoist according to claim 1, wherein the wire, one end of which is secured to the upper sheave, is repeatedly wound in plural lines on the lower sheave and the upper sheave and then is wound on the friction wheel by way of the auxiliary sheave located at one side of the upper sheave, and the wire at the drawing side wound on the friction wheel is guided to the driven friction wheel so as to be wound on the wire drum by way of the vertical stationary guide roller, the horizontal stationary guide rollers, the horizontal movable guide rollers, and the vertical movable guide roller in sequence.

* * * * *